US006575593B2

(12) United States Patent
Krietzman

(10) Patent No.: US 6,575,593 B2
(45) Date of Patent: Jun. 10, 2003

(54) IEEE 1394 OR USB POWERED COMPUTER LIGHT

(76) Inventor: Mark Howard Krietzman, P.O. Box 3185, Palos Verdes, CA (US) 90274

( * ) Notice: Subject to any disclaimer, the term of this patent is extended or adjusted under 35 U.S.C. 154(b) by 0 days.

(21) Appl. No.: 09/862,885

(22) Filed: May 21, 2001

(65) Prior Publication Data

US 2001/0043468 A1 Nov. 22, 2001

Related U.S. Application Data

(60) Provisional application No. 60/206,096, filed on May 20, 2000.

(51) Int. Cl.[7] ..... F21L 4/04

(52) U.S. Cl. ..... 362/199; 362/198; 362/287; 362/427; 362/800

(58) Field of Search ..... 362/198, 199, 362/287, 427, 800

(56) References Cited

U.S. PATENT DOCUMENTS

| | | | | | |
|---|---|---|---|---|---|
| 4,298,873 | A | * | 11/1981 | Roberts | 342/375 |
| 5,379,201 | A | | 1/1995 | Friedman | |
| 5,615,945 | A | | 4/1997 | Tseng | |
| 6,056,420 | A | * | 5/2000 | Wilson et al. | 362/230 |
| D435,679 | S | | 12/2000 | Naghi | |
| 6,186,636 | B1 | | 2/2001 | Naghi | |
| 6,260,984 | B1 | | 7/2001 | Naghi | |
| 6,318,873 | B1 | | 11/2001 | Naghi | |
| D452,026 | S | | 12/2001 | Naghi | |
| 6,386,724 | B2 | * | 5/2002 | Naghi | 345/905 |
| 6,409,532 | B2 | * | 6/2002 | Payson et al. | 439/320 |
| 2001/0028562 | A1 | | 10/2001 | Naghi | |
| 2001/0048409 | A1 | | 12/2001 | Kim | |

FOREIGN PATENT DOCUMENTS

| | | | |
|---|---|---|---|
| WO | WO/01/92781 | * | 5/2001 |
| WO | WO 01/92781 | | 12/2001 |

* cited by examiner

*Primary Examiner*—Sandra O'Shea
*Assistant Examiner*—Mark Tsidulko
(74) *Attorney, Agent, or Firm*—Mark Krietzman

(57) ABSTRACT

A light for use with computers containing one or more light emitting diodes on one or more flexible necks which is powered via the computers USB or IEEE 1394 port. An auxiliary USB or IEEE 1394 port may be combined with the plug-in light to allow for additional devices top be connected through the same port powering the light.

24 Claims, 1 Drawing Sheet

IEEE 1394 OR USB POWERED COMPUTER LIGHT

RELATED APPLICATIONS

The invention claims the benefit, under Title 35, United States Code 119 (e), of Provisional Patent Applications: No. 60/206,096, filed May 20, 2000, entitled "IEEE 1394 or USB Powered Computer Light"

BACKGROUND OF THE INVENTION

1. Field of the Invention

This present invention relates to a LED lamp for use with desktop, laptop and palmtop computers. More specifically, to a LED illuminator powered via the USB or the IEEE 1394 port.

2. Related Art

One prior art computer light is taught in U.S. Pat. No. 5,379,201, issued to Friedman, which is essential a flashlight with its own power supply affixed to a computer. Absent from the art is a light or illuminator powered by the USB or IEEE 1394 port of a computer.

SUMMARY OF INVENTION

The present invention is a light emitting diode (LED) illuminator that plugs into a USB or IEEE 1394 port and draws its power from the USB or IEEE 1394 port. The LED is supported on a flexible neck for easy positioning.

One or more LEDs on one or more flexible necks may be powered by the same port. Current drain on the computer can be minimized with current limiting circuitry.

Some computers have only a single free USB or Firewire (IEEE 1394) port, accordingly the within computer light may also be configured attached to an auxiliary USB or IEEE 1394 port to allows additional connections to the computer through the same port powering the light.

The features of the invention believed to be novel are set forth with particularity in the appended claim. The invention itself, however, both as to configuration, and method of operation, and the advantages thereof, may be best understood by reference to the following descriptions taken in conjunction with the accompanying drawings.

MODES FOR CARRYING OUT THE PREFERRED EMBODIMENTS OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Figure 1:
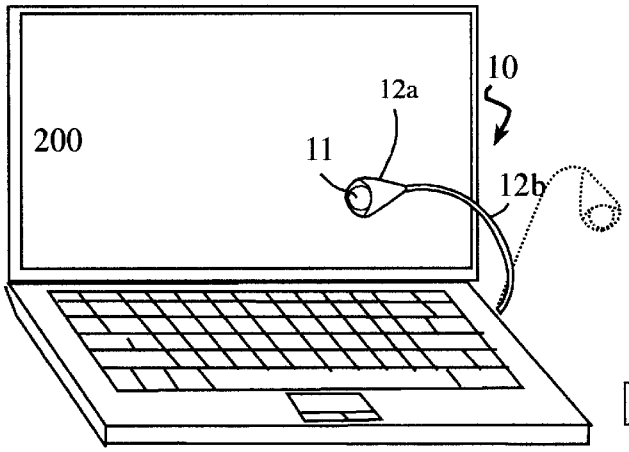
FIG. 1 is a front perspective view of the preferred embodiment of the computer light.
Figure 2:
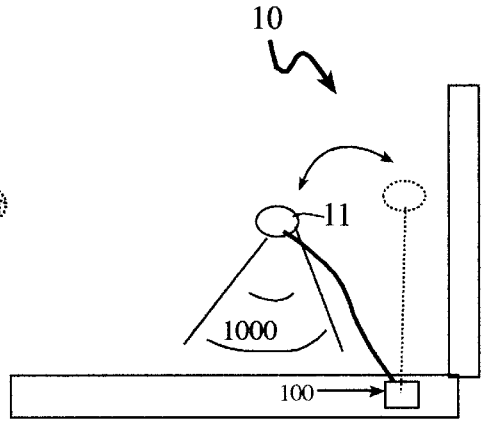
FIG. 2 is a side view of the preferred embodiment.

For the preferred embodiment shown in FIGS. 1 & 2 a single light-emitting diode "LED" 11 is affixed to a LED receiving head 12*a* at the end a flexible neck 12*b* which in turn is attached to a male jack 13, via two long conductive lead wires (not shown), which mates with either the USB or IEEE 1394 port 100 on a computer 200 to produce an illumination 1000. It is envisioned that dual LEDs may be substituted for the single LED without departing from the intended scope of the invention. Light emitting diodes 11 useful for this illuminator include, but are not limited to, those associated with wavelength in a specific spectral region, (visible or non-visible) such as red light, blue light, or yellow light, IR, UV and those which produce a wide spectrum (white light) comprising more than one distinct spectral region of light.

Figure 3A:
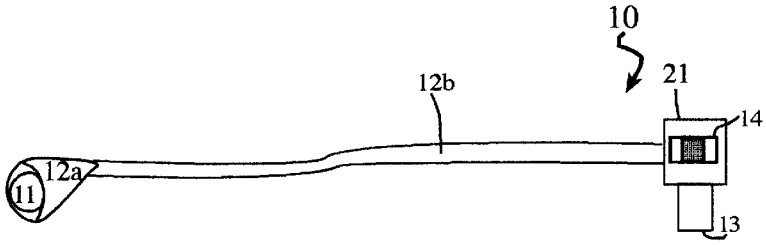
FIG. 3A is a component view of the computer light of FIG. 1.
Figure 3B:
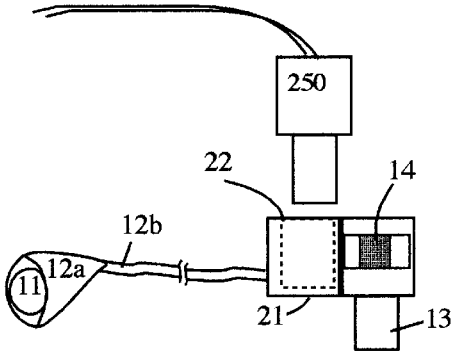
FIG. 3B is an another embodiment with pass-through connectivity, of the computer light.

In FIGS. 3A & 3B an "on/off" slide switch 14, which allows selective turning "on" and "off" of the LED 11, is shown integrated into the connector body 21 from which extends the male jack 13. In a dual LED dual flexible neck configuration dual switch may be used, or a multi-function single switch controlling the current to both LEDs. In FIG. 3B an auxiliary female USB or IEEE 1394 port 22 is connected to, or formed as part of, the connector body 21 which is able to receive a USB or IEEE 1394 plug 250 from a peripheral component such as a printer, keyboard, mouse or zip drive.

The current to the auxiliary female USB or IEEE 1394 port 22 is non-switched (not interrupted when the "on/off" slide switch 14 on the connector body 21 is switched (FIG. 5)).

Figure 4:
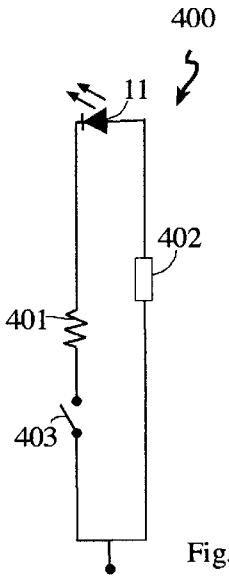
FIG. 4 is a circuit schematic for the preferred embodiment.

Referring now to FIG. 4 there are illustrated a circuit schematic for the preferred embodiment, generally designated 400.

The current to the LED ii may be limited by placing a resistor 401 in the circuit an additional voltage controlling device may also be added 402. The on/off switch 403 is used to power the LED 11.

Figure 5:
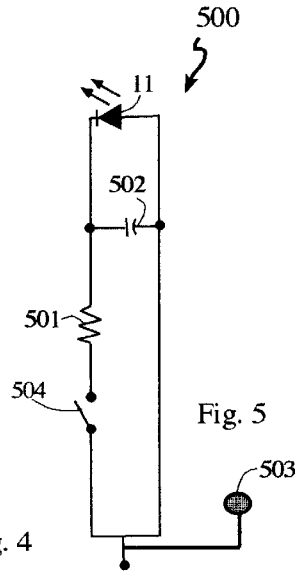
FIG. 5 is an alternate circuit schematic for the computer light.

Referring now to FIG. 5 there are illustrated an alternate circuit schematic for the computer light, generally designated 500.

The LED 11 is run efficiently by placing a resistor 501 in the circuit, a capacitor 502 may be added to strobe the LED ii at a rate above the visual threshold. A fully powered USB or IEEE 1394 female port 503 shunts off the computers powered port, and is thereby not effected by the on/off switch 504

Since certain changes may be made in the above apparatus without departing from the scope of the invention herein involved, it is intended that all matter contained in the above description, as shown in the accompanying drawing, shall be interpreted in an illustrative, and not a limiting sense.

What is claimed is:

1. A computer light comprising:

a light-emitting diode;

a male jack which mates with a USB or IEEE 1394 port;

two long conductive lead wires each affixed at one end to either the anode or cathode of the light-emitting diode and at the other end to the appropriate contact on the male jack; and, a flexible support member to which said light-emitting diode and said long conductive lead wires and said male jack are affixed.

2. The computer light of claim 1, further comprising an on/off switch.

3. The computer light of claim 1, further comprising a connector body which supports both the flexible support member and the male jack.

4. The computer light of claim 1, further comprising a non-switched female USB or IEEE 1394 port formed as part of, or affixed to, said male jack.

5. The computer light of claim 1, further comprising a non-switched female USB or IEEE 1394 port formed as part of, or affixed to, the connector body.

6. The computer light of claim 1, further comprising current limiting circuitry of at least one resistor placed in between the light emitting diode and the male jack.

7. The computer light of claim 1, further comprising strobing circuitry, whereby the light-emitting diode may be strobed at a rate above the visual threshold.

8. The computer light of claim 1, wherein the light-emitting diode emits a pre-determined wavelength between 400–700 nm.

9. The computer light of claim 1, wherein the light-emitting diode emits white light.

10. A computer light comprising:

Two pairs of long conductive lead wires, two or more light-emitting diodes, each conductively linked to one pair of said long conductive lead wires;

two or more flexible support member each of which supports on light-emitting diode and long conductive lead wire; and, a male jack which mates with a USB or IEEE 1394 port at one end, and which is conductively attached to both pairs of long conductive lead wires and flexible members at the other end.

11. The computer light of claim 10, further comprising an on/off switch for each of the two or more light emitting diodes.

12. The computer light of claim 10, further comprising a single on/off switch for the two or more light emitting diodes.

13. The computer light according to claim 10, further comprising a female USB or IEEE 1394 port formed as part of, or affixed to, said male jack.

14. The computer light of claim 10, further comprising a connector body which supports both the flexible support member and the male jack.

15. The computer light of claim 13, further comprising a connector body which supports both the flexible support member and the male jack.

16. The computer light of claim 10, further comprising current limiting circuitry of at least one resistor placed in between the at least light emitting diode and the male jack.

17. The computer light of claim 10, further comprising strobing circuitry, whereby the light-emitting diode may be strobed at a rate above the visual threshold.

18. The computer light according to claim 10, wherein each of the two or more the light-emitting diodes emits a light at a pre-determined wavelength between 400–700 nm.

19. The computer light according to claim 10, wherein each of the two or more the light-emitting diodes emits white light.

20. A computer light comprising:

a connector body;

a male jack which mates with a USB or IEEE 1394 port extending from the connector body;

an elongated flexible support member affixed at one end to the connector body and with a second end;

a LED receiving head affixed to, or formed as part of the second end of the flexible neck;

a light-emitting diode with an anode and cathode lead wire mounted within the LED receiving head;

two long conductive lead wires each affixed at one end to either the anode or cathode of the light-emitting diode and attached at the other end to the appropriate contact on the male jack;

said conductive lead wires each support by the flexible support; and, a resistor interposed between the light emitting diode and the male jack; and, an on/off switch interposed between the male jack and the light emitting diode.

21. A computer light comprising:

a connector body;

a male jack, corresponding to a USB or IEEE 1394 port affixed to the connector body;

at least one flexible elongated support member affixed to the connector body;

at least one light emitting diode supported at the second end of the at least one flexible elongated support; and, conductive lead wires connecting each light emitting diode to the male jack.

22. The computer light of claim 21 further comprising current limiting circuitry.

23. The computer light of claim 21 further comprising an on/off switch to control each of the at least one light emitting diodes.

24. A computer light comprising:

a flexible elongated support with a first and second end;

a male USB or IEEE 1394 jack affixed at the first end; and, at least one light emitting diode conductively linked to the male USB or IEEE 1394 jack affixed to the second end.

* * * * *

UNITED STATES PATENT AND TRADEMARK OFFICE

CERTIFICATE OF CORRECTION

PATENT NO. : 6,575,593 B2
DATED : June 10, 2003
INVENTOR(S) : Mark Howard Krietzman It is certified that error appears in the above-identified patent and that said Letters Patent is hereby corrected as shown below:

Column 2,
Line 59, after “a” and before “light-emitting” insert -- visible spectrum --.

Column 3,
Line 25, after “more” and before “light-emitting” insert -- visible spectrum --.

Column 4,
Line 17, after “a” and before “light-emitting” insert -- visible spectrum --.
Lines 37 and 51, after “one” and before “light-emitting” insert -- visible spectrum --.

Signed and Sealed this

Nineteenth Day of October, 2004

JON W. DUDAS
*Director of the United States Patent and Trademark Office*